US007594554B2

(12) United States Patent
Schwefe et al.

(10) Patent No.: US 7,594,554 B2
(45) Date of Patent: Sep. 29, 2009

(54) CUTTING ELEMENT INSERT FOR BACKUP CUTTERS IN ROTARY DRILL BITS, ROTARY DRILL BITS SO EQUIPPED, AND METHODS OF MANUFACTURE THEREFOR

(75) Inventors: Thorsten Schwefe, Celle (DE); Thomas Ganz, Bergen (DE)

(73) Assignee: Baker Hughes Incorporated, Houston, TX (US)

( * ) Notice: Subject to any disclaimer, the term of this patent is extended or adjusted under 35 U.S.C. 154(b) by 204 days.

(21) Appl. No.: 11/709,925

(22) Filed: Feb. 21, 2007

(65) Prior Publication Data

US 2007/0199739 A1 Aug. 30, 2007

Related U.S. Application Data

(60) Provisional application No. 60/775,866, filed on Feb. 23, 2006.

(51) Int. Cl.
*E21B 10/46* (2006.01)
*E21B 10/56* (2006.01)

(52) U.S. Cl. ..... 175/428; 175/431; 175/432

(58) Field of Classification Search ..... 175/431, 175/432, 428, 426
See application file for complete search history.

(56) References Cited

U.S. PATENT DOCUMENTS 4,014,395 A 3/1977 Pearson
4,073,354 A * 2/1978 Rowley et al. ..... 175/430
4,199,035 A 4/1980 Thompson
4,200,159 A 4/1980 Peschel et al.
4,271,917 A 6/1981 Sahley
4,334,585 A 6/1982 Upton
4,351,401 A 9/1982 Fielder
4,382,477 A 5/1983 Barr
4,453,605 A 6/1984 Short, Jr.
4,505,342 A 3/1985 Barr et al.
4,520,881 A * 6/1985 Phaal ..... 175/433
4,529,048 A 7/1985 Hall
4,538,690 A 9/1985 Short, Jr.
4,553,615 A 11/1985 Grainger
4,782,903 A 11/1988 Strange (Continued)

FOREIGN PATENT DOCUMENTS

GB 084 219 A 4/1982

OTHER PUBLICATIONS

U.S. Appl. No. 11/271,153, filed Nov. 10, 2005 to Oxford et al., entitled, "Earth-Boring Rotary Drill Bits and Methods of Forming Earth-Boring Rotary Drill Bits."

(Continued)

*Primary Examiner*—Giovanna C Wright
(74) *Attorney, Agent, or Firm*—TraskBritt

(57) ABSTRACT

Cutter inserts for rotary drill bits include a cutter insert body having a cutter recess configured to receive a backup cutter therein. Rotary drill bits for drilling a subterranean formation include at least one such cutter insert affixed to a blade rotationally behind a cutter pocket for a primary cutter. Methods of manufacturing such drill bits include providing a bit body having a plurality of blades. A cutter insert is provided and secured within a cutter insert recess formed in the face of a blade. A backup cutter is secured within a cutter recess of the cutter insert.

49 Claims, 13 Drawing Sheets

U.S. PATENT DOCUMENTS

| | | | |
|---|---|---|---|
| 4,877,096 | A | 10/1989 | Tibbitts |
| 5,007,493 | A | 4/1991 | Coolidge et al. |
| 5,056,382 | A | 10/1991 | Clench |
| 5,213,171 | A | 5/1993 | Clench et al. |
| 5,279,375 | A | 1/1994 | Tibbitts et al. |
| H1566 | H | 8/1996 | Azar |
| 5,558,170 | A | 9/1996 | Thigpen et al. |
| 5,678,645 | A | 10/1997 | Tibbitts et al. |
| 5,890,552 | A | 4/1999 | Scott et al. |
| 5,906,245 | A | 5/1999 | Tibbitts et al. |
| 6,302,224 | B1 | 10/2001 | Sherwood, Jr. |
| 7,070,011 | B2 | 7/2006 | Sherwood, Jr. et al. |
| 2005/0103533 | A1 | 5/2005 | Sherwood, Jr. et al. |

OTHER PUBLICATIONS

U.S. Appl. No. 11/272,439, filed Nov. 10, 2005 to Smith et al., entitled, "Earth-Boring Rotary Drill Bits and Methods of Manufacturing Earth-Boring Rotary Drill Bits Having Particle-Matrix Composite Bit."

* cited by examiner

CUTTING ELEMENT INSERT FOR BACKUP CUTTERS IN ROTARY DRILL BITS, ROTARY DRILL BITS SO EQUIPPED, AND METHODS OF MANUFACTURE THEREFOR

CROSS-REFERENCE TO RELATED APPLICATION

This application claims the benefit of U.S. Provisional Patent Application Ser. No. 60/775,866, filed Feb. 23, 2006, the disclosure of which is incorporated herein in its entirety by this reference.

FIELD OF THE INVENTION

The present invention relates generally to fixed-cutter rotary drill bits having a bit body and, more specifically, to retention of backup cutting elements within a bit body of a rotary drill bit for drilling subterranean formations.

BACKGROUND OF THE INVENTION

Rotary drill bits are commonly used for drilling bore holes or wells in earth formations. One type of rotary drill bit is the fixed-cutter bit (often referred to as a "drag" bit), which typically includes a plurality of cutting elements secured to a face region of a bit body. Generally, the cutting elements of a fixed-cutter type drill bit have either a disk shape or, in some instances, a more elongated, substantially cylindrical shape. A cutting surface comprising a hard, super-abrasive material, such as mutually bound particles of polycrystalline diamond forming a so-called "diamond table," may be provided on a substantially circular end surface of a substrate of each cutting element. Such cutting elements are often referred to as "polycrystalline diamond compact" (PDC) cutting elements or cutters. Typically, the PDC cutting elements are fabricated separately from the bit body and secured within pockets formed in the outer surface of the bit body. A bonding material such as an adhesive or, more typically, a braze alloy may be used to secure the cutting elements to the bit body.

The bit body of a rotary drill bit typically is secured to a hardened steel shank having an American Petroleum Institute (API) thread connection for attaching the drill bit to a drill string. The drill string includes tubular pipe and equipment segments coupled end-to-end between the drill bit and other drilling equipment at the surface. Equipment such as a rotary table or top drive may be used for rotating the drill string and the drill bit within the bore hole. Alternatively, the shank of the drill bit may be coupled directly to the drive shaft of a down-hole motor, which then may be used to rotate the drill bit.

Referring to FIG. 1, a conventional fixed-cutter rotary drill bit 10 includes a bit body 12 that has generally radially projecting and longitudinally extending wings or blades 14, which are separated by junk slots 16 extending from channels on the face 20 of the bit body. A plurality of PDC cutters 18 are provided on the blades 14 extending over face 20 of the bit body 12. The face 20 of the bit body 12 includes the surfaces of the blades 14 that are configured to engage the formation being drilled, as well as the exterior surfaces of the bit body 12 within the channels and junk slots 16. The plurality of PDC cutters 18 may be provided along each of the blades 14 within pockets 22 formed in rotationally leading edges thereof, and the PDC cutters 18 may be supported from behind by buttresses 24, which may be integrally formed with the bit body 12.

The drill bit 10 may further include an API threaded connection portion 30 for attaching the drill bit 10 to a drill string (not shown). Furthermore, a longitudinal bore (not shown) extends longitudinally through at least a portion of the bit body 12, and internal fluid passageways (not shown) provide fluid communication between the longitudinal bore and nozzles 32 provided at the face 20 of the bit body 12 and opening onto the channels leading to junk slots 16.

During drilling operations, the drill bit 10 is positioned at the bottom of a well bore hole and rotated while drilling fluid is pumped through the longitudinal bore, the internal fluid passageways, and the nozzles 32 to the face 20 of the bit body 12. As the drill bit 10 is rotated, the PDC cutters 18 scrape across and shear away the underlying earth formation. The formation cuttings mix with and are suspended within the drilling fluid and pass through the junk slots 16 and up through an annular space between the wall of the bore hole and the outer surface of the drill string to the surface of the earth formation.

The bit body 12 of a fixed-cutter rotary drill bit 10 may be formed from steel. Such steel bit bodies are typically fabricated by machining a steel blank (using conventional machining processes including, for example, turning, milling, and drilling) to form the blades 14, junk slots 16, pockets 22, buttresses 24, internal longitudinal bore and fluid passageways (not shown), and other features of the drill bit 10.

FIG. 2 is an enlarged perspective view of a blade 14 showing a plurality of PDC cutters 18 mounted thereon in pockets 22 and supported from behind by buttresses 24. As seen therein, the PDC cutters 18 may include a polycrystalline diamond compact table 36 formed on a substantially planar end surface of a cylindrical substrate 38, the latter being formed of a hard metallic material such as tungsten carbide. Generally, the PDC cutters 18 are secured by their substrates 38 within the pockets 22 by brazing, welding, or adhering using a high-strength adhesive.

In order to enhance the cutting action of the drill bit 10 and/r to prevent wear of drill bit 10, it may be desirable to provide additional "backup" cutters 18' on one or more blades 14 rotationally behind at least some of the primary PDC cutters 18.

Provision of such backup cutters 18' in a drill bit 10 that includes a steel bit body 12 may be difficult due to the difficulty of machining pockets 22' for the backup cutters 18' using conventional machining equipment (such as, for example, a multiple-axis milling machine) and techniques due to interference between the machining equipment or the cutting element thereof and other features of the drill bit 10 such as, for example, adjacent blades 14. Stated another way, interference between the machining equipment and the drill bit 10 may preclude positioning of the machining equipment and, in particular, the cutting element thereof, in a manner that allows machining of the pockets 22' for the backup cutters 18'. Furthermore, it may be difficult to machine the pockets 22' for backup cutters 18' without machining other areas of the drill bit 10 that are not intended to be machined.

U.S. Pat. No. 7,070,011 to Sherwood, Jr., et al. discloses steel body rotary drill bits having primary cutting elements that are disposed in cutter pocket recesses that are partially defined by cutter support elements. The support elements are affixed to the steel body during fabrication of the drill bits. At least a portion of the body of each cutting element is secured to a surface of the steel bit body, and at least another portion of the body of each cutting element matingly engages a surface of one of the support elements. U.S. Pat. No. 7,070,011 does not describe, teach, or suggest, however, using the support elements disclosed therein to secure backup cutters to a rotary drill bit having a steel body.

Therefore, there is a need in the art for methods that facilitate placement of backup cutters on rotary drill bits, and for rotary drill bits including backup cutters.

BRIEF SUMMARY OF THE INVENTION

In some embodiments, the present invention includes cutter inserts for fixed-cutter rotary drill bits. The cutter inserts have a cutter insert body including at least one surface defining a cutter recess in the cutter insert body. The cutter recess may be configured to receive at least a portion of a backup cutting element therein.

In additional embodiments, the present invention includes fixed-cutter rotary drill bits for drilling subterranean formations. At least one cutter insert for retaining a backup cutter may be removably affixed to the face of a bit body rotationally behind a cutter pocket for a primary cutter. The cutter insert may include at least one surface defining a cutter recess therein that is configured to receive at least a portion of the backup cutter (such as, for example, a PDC cutting element) therein. The back rake and exposure of the backup cutter may be easily adjusted by appropriately configuring the position and orientation of the cutter recess.

In yet additional embodiments, the present invention includes methods of manufacturing fixed-cutter rotary drill bits. The methods may include providing a bit body (which may have a plurality of blades) having a face configured to engage a subterranean formation during drilling. At least one cutter insert recess is formed in the face of the bit body (e.g., on the face of a blade) rotationally behind a cutter pocket that is configured to receive a primary cutting element therein. One or more cutter inserts may be provided that include a cutter insert body having at least one surface defining a cutter recess therein that is configured to receive at least a portion of a backup cutting element therein. The one or more cutter inserts each may be secured at least partially within a cutter insert recess on the face of the bit body, and at least one backup cutter may be secured at least partially within the cutter recesses of the one or more cutter inserts. The one or more cutter inserts may be removably secured in the cutter insert recesses to facilitate removal and repair of components of the cutter insert/backup cutting element assemblies.

BRIEF DESCRIPTION OF THE SEVERAL VIEWS OF THE DRAWINGS

While the specification concludes with claims particularly pointing out and distinctly claiming that which is regarded as the present invention, various features and advantages of this invention may be more readily ascertained from the following description of the invention when read in conjunction with the accompanying drawings, in which:

DETAILED DESCRIPTION OF THE INVENTION

The illustrations presented herein are, in some instances, not actual views of any particular cutting element insert, cutting element, or drill bit, but are merely idealized representations which are employed to describe the present invention. Additionally, elements common between figures may retain the same numerical designation.

Figure 3A:
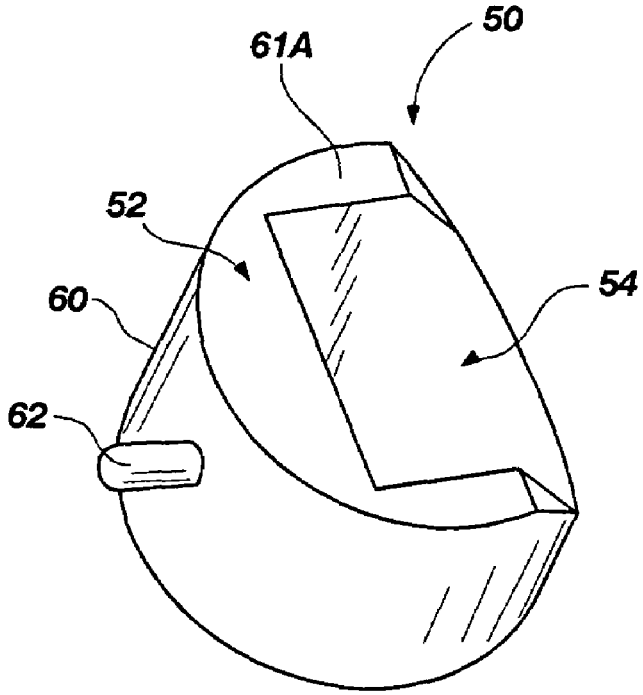
FIG. 3A is a perspective view of an embodiment of a cutter insert that may be used to mount a backup cutter on the blade of a rotary drill bit.

A cutter insert 50 that may be used to secure a backup cutter 18' on the face 20 of a rotary drill bit 10 (FIG. 1) (which may have a steel bit body) is shown in FIGS. 3A-3D. Referring to FIG. 3A, the cutter insert 50 may include a generally cylindrical cutter insert body 52 having a cutter recess 54 provided at one end thereof. The cutter insert body 52 may comprise, for example, a steel alloy, tungsten carbide, or any other sufficiently hard and wear-resistant material. As another example, the cutter insert body 52 may comprise a particle-matrix composite material such as, for example, a material comprising tungsten carbide particles cemented together by a metal matrix material, such as, for example, cobalt or a cobalt-based alloy.

Figure 2:
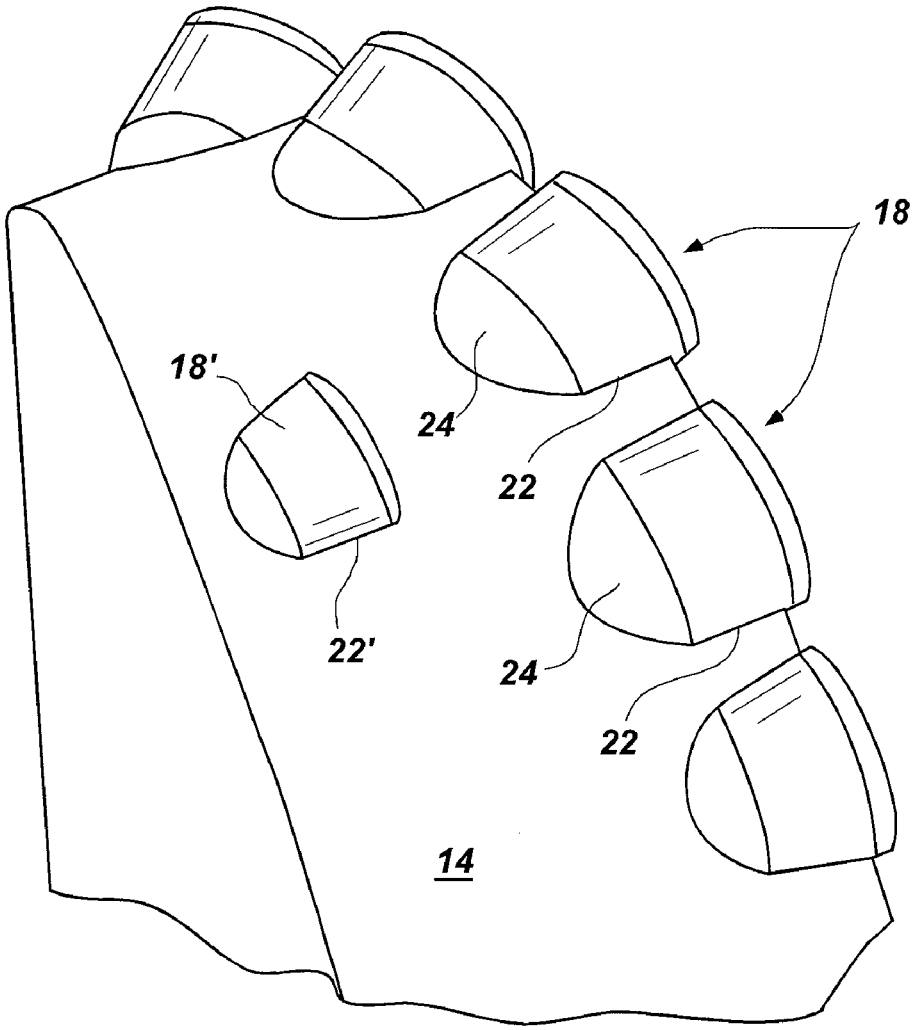
FIG. 2 is an enlarged view of a blade of a fixed-cutter rotary drill bit like that shown in FIG. 1 illustrating a backup cutter mounted on the blade in accordance with an embodiment of the present invention.
Figure 3B:
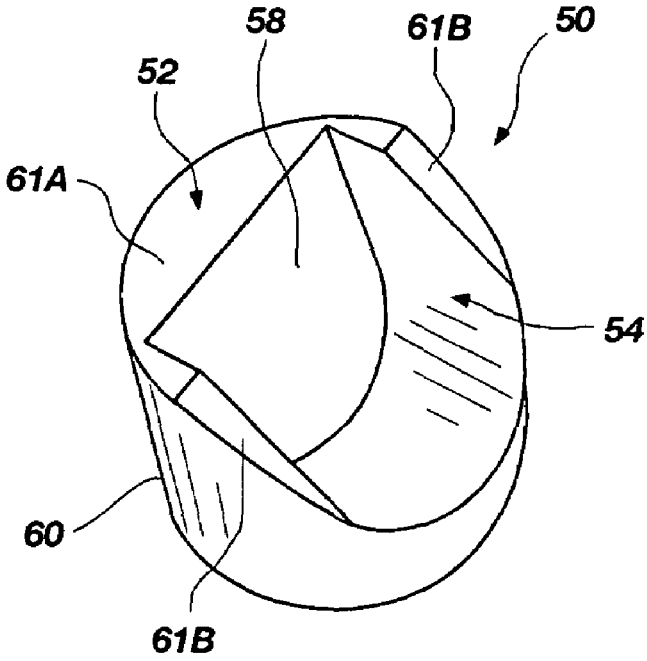
FIG. 3B is another perspective view of the cutter insert shown in FIG. 3A.
Figure 3C:
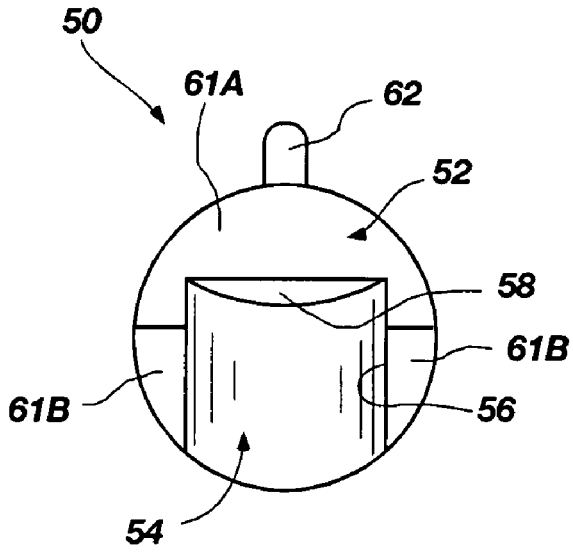
FIG. 3C is a top view of the cutter insert shown in FIG. 3A.
Figure 3D:
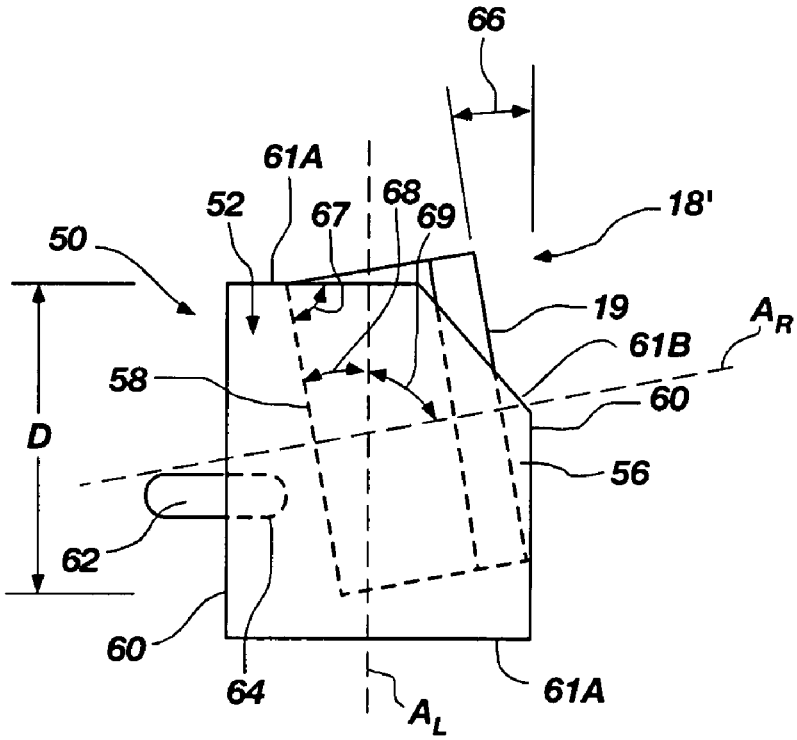
FIG. 3D is a side view of the cutter insert shown in FIG. 3C.

Referring to FIGS. 3B and 3C, the cutter insert body 52 may have a generally cylindrical lateral side surface 60 and two opposing substantially planar and parallel end surfaces 61A, only one of which is visible in FIGS. 3A, 3B, and 3C. In some embodiments, the cutter insert body 52 also may have one or more additional substantially planar flat surfaces 61B, which may be co-planar and disposed in a plane oriented at an acute angle of less than ninety degrees (90°) relative to the parallel end surfaces 61A. The cutter recess 54 may have a size and shape configured to receive a backup cutter 18' (FIG. 2) at least partially therein. In some embodiments, the cutter recess 54 may have a size and shape configured to receive a backup cutter 18' substantially entirely therein, such that the backup cutter 18' does not project laterally outward from the cutter insert body 52 beyond the generally cylindrical lateral side surface 60, as shown in FIG. 3D. In other words, the backup cutter 18' may only project vertically outwardly beyond the upper end surface 61A, as shown in FIG. 3D.

By way of example and not limitation, the cutter recess 54 (FIG. 3C) may have a shape corresponding to a partial right-ended cylinder, and may be defined by a generally cylindrical, arcuate surface 56 of the cutter insert body 52 and a generally planar surface 58 of the cutter insert body 52, at which the arcuate surface 56 terminates. In other words, the arcuate surface 56 intersects the planar surface 58 and may extend substantially transverse therefrom. In some embodiments, the generally planar surface 58 also may be disposed in a plane oriented at an acute angle 67 of less than ninety degrees (90°) relative to one or both of the end surfaces 61A, and/or at an acute angle 68 of less than ninety degrees (90°) relative to the longitudinal axis $A_L$ of the cutter insert body 52. The cutter recess 54 may intersect one or more of the flat surfaces 61B, the lateral side surface 60, and an end surface 61A, as shown in FIG. 3B. Furthermore, the cutter recess 54 may extend along a recess axis $A_R$ that is oriented at an acute angle 69 of less than ninety degrees (90°) relative to the longitudinal axis $A_L$ of the cutter insert body 52. As used herein, the term "recess axis" means any axis about which the shape of the cutter recess 54 is substantially symmetric. In some embodiments, the recess axis may be co-incident with a drilling or machining axis used to form the cutter recess 54. In such a configuration, the recess axis $A_R$ also may be oriented at an acute angle of less than ninety degrees (90°) relative to the lateral side surface 60. A backup cutter 18' such as, for example, a PDC backup cutter 18' may be at least partially received within the cutter recess 54 of the cutter insert body 52, as shown in FIG. 3D.

As shown in FIG. 3D, the cutter recess 54 (FIG. 3C) may be selectively oriented within the cutter insert body 52 such that the cutting face 19 of a backup cutter 18' positioned therein is oriented at a selected angle 66 with respect to a side surface 60 of the cutter insert body 52, which is parallel to a longitudinal axis $A_L$ of the cutter insert body 52. The selected angle 66 may be used to define a selected back rake angle of the backup cutter 18' when the cutter insert 50 is secured to the face 20 of a drill bit 10 (FIG. 1), and the backup cutter 18' is positioned within the cutter recess 54 of the cutter insert 50. Similarly, the depth D of cutter recess 54 in cutter insert body 52 may be adjusted to provide a selected exposure for a backup cutter 18' when the cutter insert 50 is secured to the face 20 of a drill bit 10 (FIG. 1), and the backup cutter 18' is positioned within the cutter recess 54 of the cutter insert 50.

As shown in FIG. 3D, the cutter insert body 52 may be configured such that the backup cutter 18' may be predominantly or primarily secured to the cutter insert body 52 within the cutter recess 54. In other words, the backup cutter 18' is not significantly directly bonded to any surface of the blade 14 of the bit body on which the backup cutter 18' is mounted.

Figure 1:
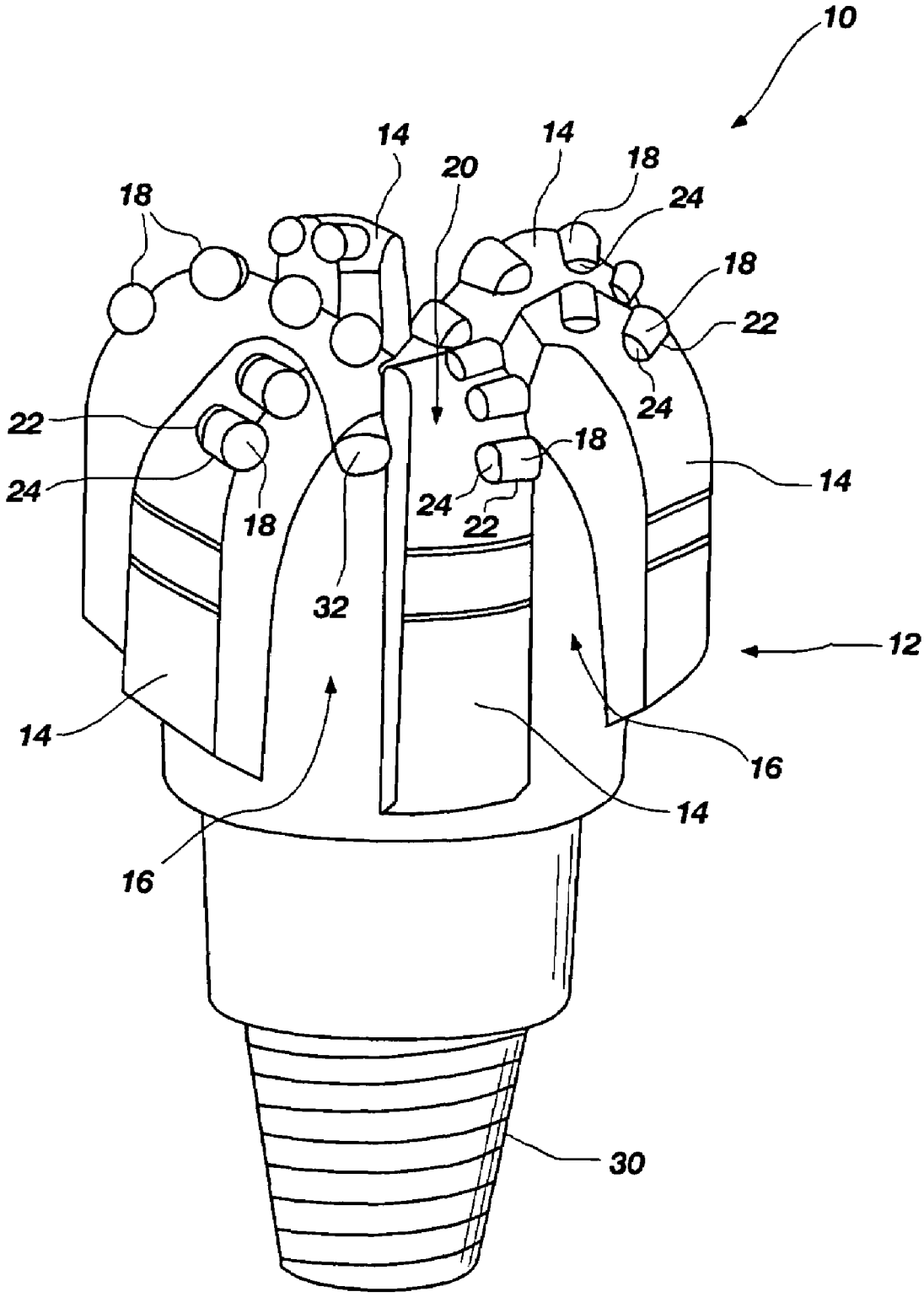
FIG. 1 is a perspective view of an example fixed-cutter rotary drill bit.

Optionally, the cutter insert 50 may include one or more alignment features configured to facilitate providing the cutter insert 50 at a selected orientation, in terms of side rake, within a bit body 12 of a drill bit 10 (FIG. 1). By way of example and not limitation, the cutter insert 50 may include a rotational alignment pin 62, which may be partially inserted into a corresponding hole 64 formed in a surface 60 of the cutter insert body 52. The rotational alignment pin 62 may be used to provide the cutter insert 50 at a selected rotational orientation within a bit body 12 of a drill bit 10, thereby defining a selected side rake angle of the backup cutter 18' when the cutter insert 50 is secured to a blade 14 over the face 20 of a drill bit 10 (FIG. 1), and the backup cutter 18' is positioned within the cutter recess 54 of the cutter insert 50.

Figure 4:
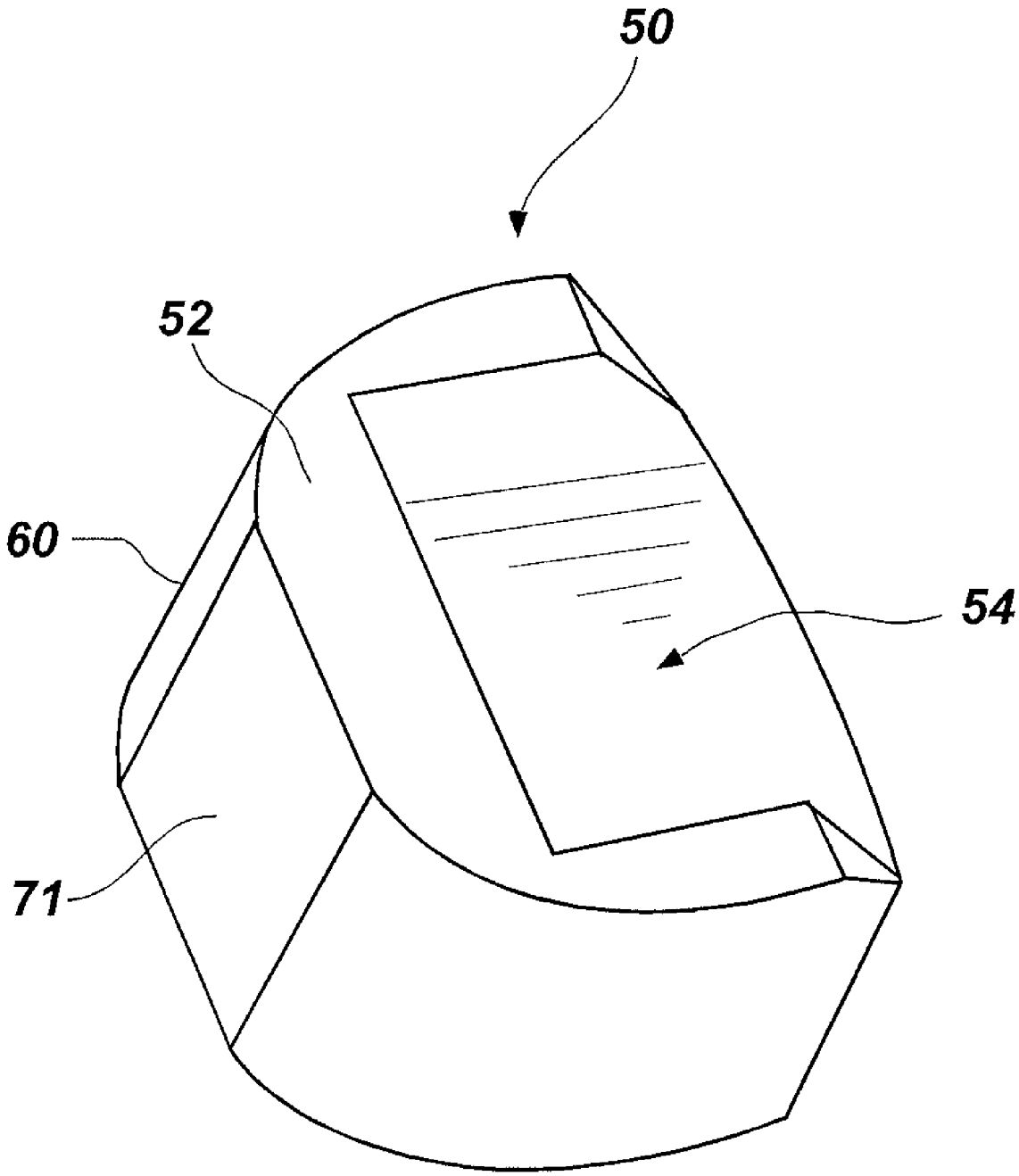
FIG. 4 is a perspective view of another embodiment of a cutter insert that may be used to mount a backup cutter on the blade of a rotary drill bit.

An additional embodiment of the cutter insert 50 is shown in FIG. 4. As seen therein, the cutter insert body 52 may include a generally planar alignment surface or flat 71, which may be formed in and intersect the lateral side surface 60 of the cutter insert body 52. The alignment surface or flat 71 may be used to provide the cutter insert 50 at a selected rotational orientation within a bit body 12 of a drill bit 10 (FIG. 1), in lieu of the rotational alignment pin 62 shown in FIGS. 3A-3D. In still further embodiments, the cutter insert 50 may include an alignment mark such as a line or groove defined in a surface of the cutter insert body 52, which may be aligned with a corresponding mark (or other feature) provided on the bit body 12 of a drill bit 10 (FIG. 1).

A method of securing a backup cutter 18' to the face 20 of a rotary drill bit 10 like that shown in FIG. 1 using the cutter insert 50 shown in FIGS. 3A-3D will now be described with reference to FIGS. 5A-5F.

Figure 5A:
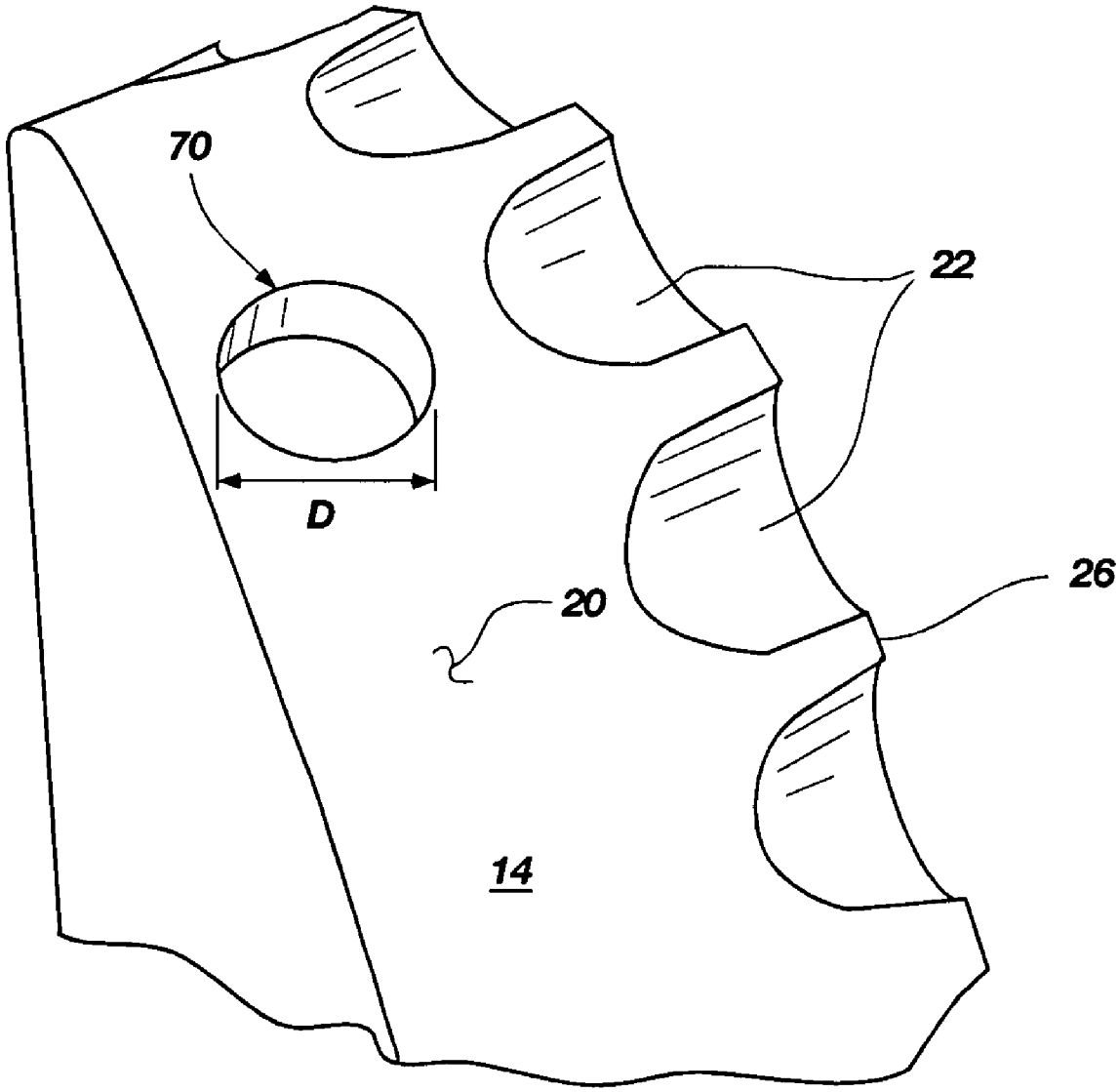
FIGS. 5A-5F illustrate a method of mounting a backup cutter on the blade of a rotary drill bit using an insert like that shown in FIGS. 3A-3D.

FIG. 5A is an enlarged partial perspective view of a blade 14 of a fixed-cutter rotary drill bit 10 like that shown in FIG. 1, which may have a steel bit body 12. The blade 14 is shown in FIG. 5A after cutter pockets 22 have been formed therein, but prior to securing primary PDC cutters 18 (FIG. 2) therein. The cutter pockets 22 have been formed adjacent to a leading surface 26 of the blade 14. The leading surface 26 generally refers to the side of the blade 14 that is rotationally forward or leading in relation to the direction of rotation of the bit body 12 during drilling. As seen in FIG. 5A, a cutter insert recess 70 may be provided in the face 20 of the blade 14 at a desired location thereon at which it is desired to provide a backup cutter 18'. For example, a cutter insert recess 70 may be provided in the face 20 of the blade 14 rotationally behind a cutter pocket 22 on that same blade that is configured to receive a primary PDC cutter 18 therein. The cutter insert recess 70 may have a size and shape configured to receive a cutter insert 50 (FIGS. 3A-3D) therein. By way of example and not limitation, the cutter insert recess 70 may be generally cylindrical and may have a diameter D that is larger than a diameter of a generally cylindrical cutter insert body 52 of a cutter insert 50 by a few to several hundredths of an inch to allow the cutter insert 50 to be welded or brazed within the cutter insert recess 70 of the blade 14. In other embodiments, the cutter insert recess 70 may have a diameter D that is larger than a diameter of the generally cylindrical cutter insert body 52 of the cutter insert 50 by a few to several thousandths of an inch to allow the cutter insert 50 to be press-fit or shrink-fit into the cutter insert recess 70 of the blade 14.

By way of example and not limitation, the cutter insert recess 70 may be formed in the blade 14 by drilling the cutter insert recess 70 into the blade 14 using, for example, a conventional drilling or milling machine equipped with a flat-bottomed cylindrical cutting element.

Figure 5B:
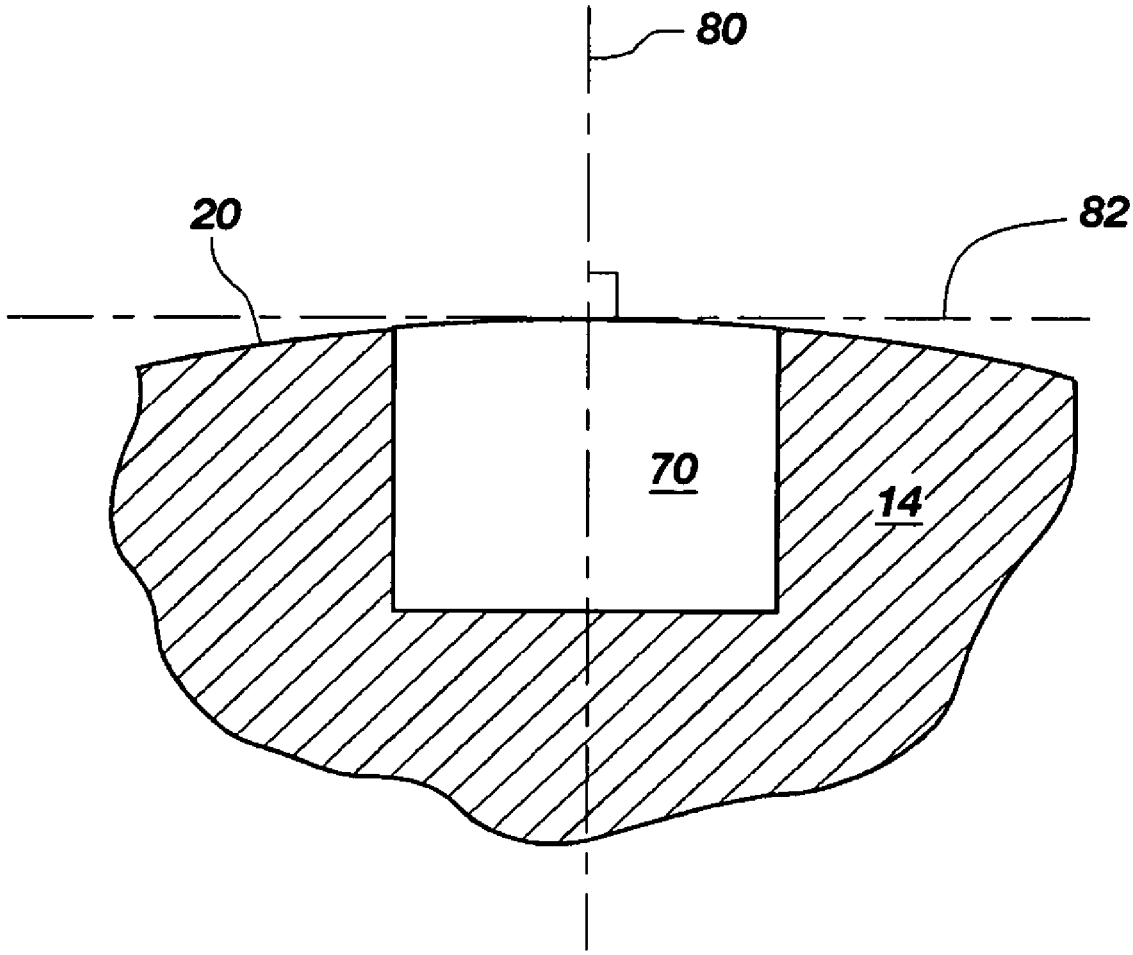

Referring to FIG. 5B, the cutter insert recess 70 may be formed by drilling into a blade 14 substantially along a drilling axis 80. By way of example and not limitation, the drilling axis 80 may be oriented generally perpendicular to a plane 82 that is substantially tangent to the face 20 of the blade 14 at the location at which the cutter insert recess 70 is to be formed. By allowing the cutter insert recess 70 to be drilled in such a manner, conventional drilling equipment and techniques maybe used to drill the cutter insert recess 70 without encountering the interference problems previously described herein that can arise when attempting to machine a cutter pocket 22' located and configured to receive a backup cutter 18' (FIG. 2) directly into a blade 14 of a drill bit 10.

Figure 5C:
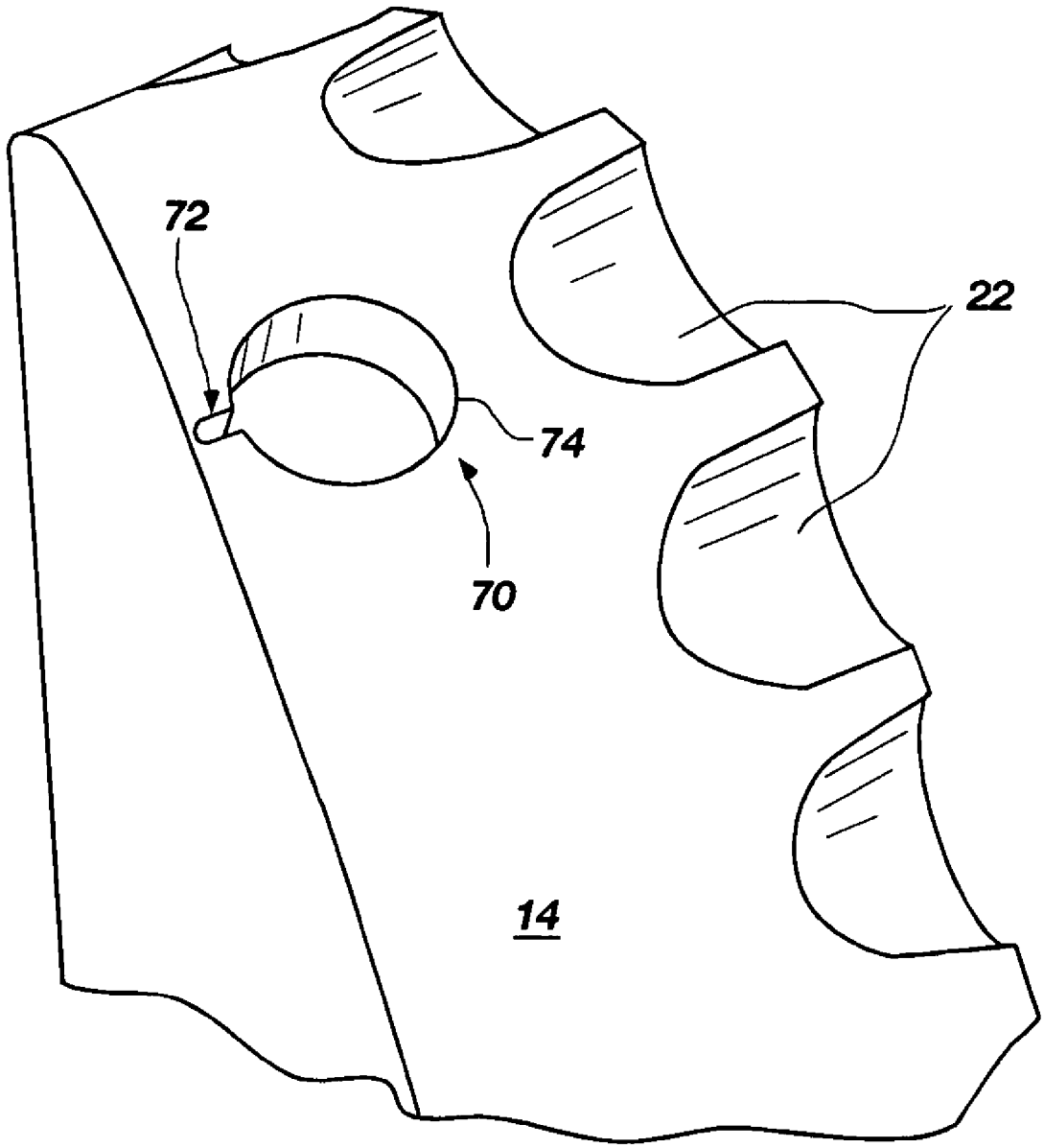

Referring to FIG. 5C, an alignment pin recess 72 that extends from the cutter insert recess 70 and is configured to receive the alignment pin 62 of the cutter insert 50 (FIGS. 3A-3D) therein may be provided in the blade 14. By way of example and not limitation, the alignment pin recess 72 may be formed in the blade 14 by milling the alignment pin recess 72 in the blade 14 using, for example, a conventional milling machine equipped with a round-bottomed cylindrical cutting element.

As previously described, the alignment pin recess 72 may be provided at a selected position about the circumferential edge 74 of the cutter insert recess 70 such that the cutter insert 50 is positioned at a selected rotational orientation within the cutter insert recess 70 when the cutter insert 50 is inserted into the cutter insert recess 70 and the alignment pin 62 is disposed within the alignment pin recess 72. In this manner, the side rake angle of a backup cutter 18' positioned within a cutter insert 50 disposed in the cutter insert recess 70 may be selectively defined.

Figure 5D:
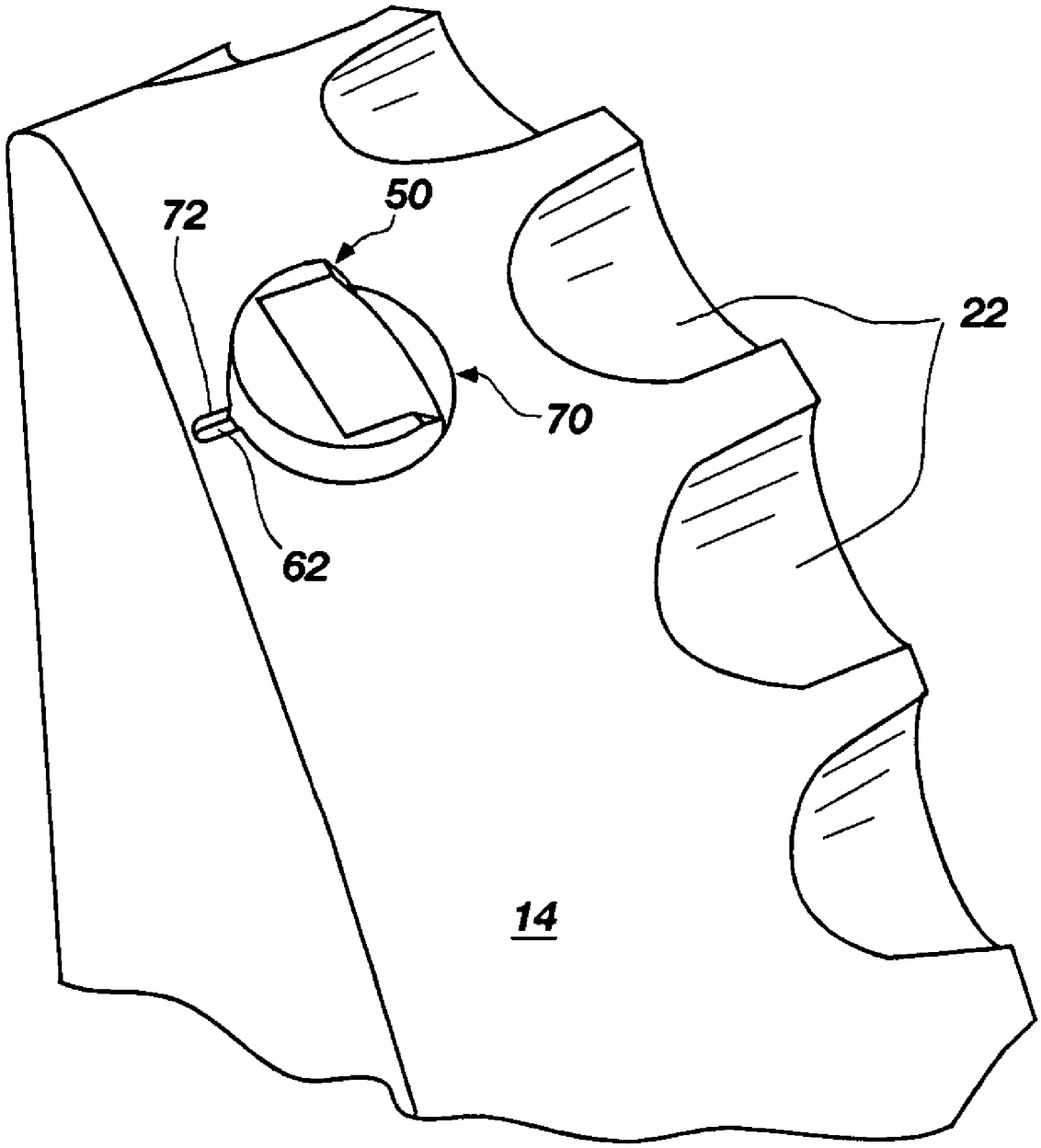

Referring to FIG. 5D, after forming the cutter insert recess 70 and the alignment pin recess 72 in the blade 14, a cutter insert 50 may be aligned with and inserted into the cutter insert recess 70 such that the alignment pin 62 is disposed in the alignment pin recess 72.

After inserting the cutter insert 50 into the cutter insert recess 70, the cutter insert 50 may be secured within the cutter insert recess 70 (if the cutter insert 50 has not been press-fit or shrink-fit into the cutter insert recess 70, or if that additional means for securing the cutter insert 50 within the cutter insert recess 70 is desired in addition to a press-fit or shrink-fit). As previously described, a brazing material or an adhesive material optionally may be provided at the interface between the cutter insert 50 and the surrounding surfaces of the blade 14 within the cutter insert recess 70. In such a configuration, cutter insert 50 may be relatively easily removed, if damaged, for replacement.

Figure 5E:
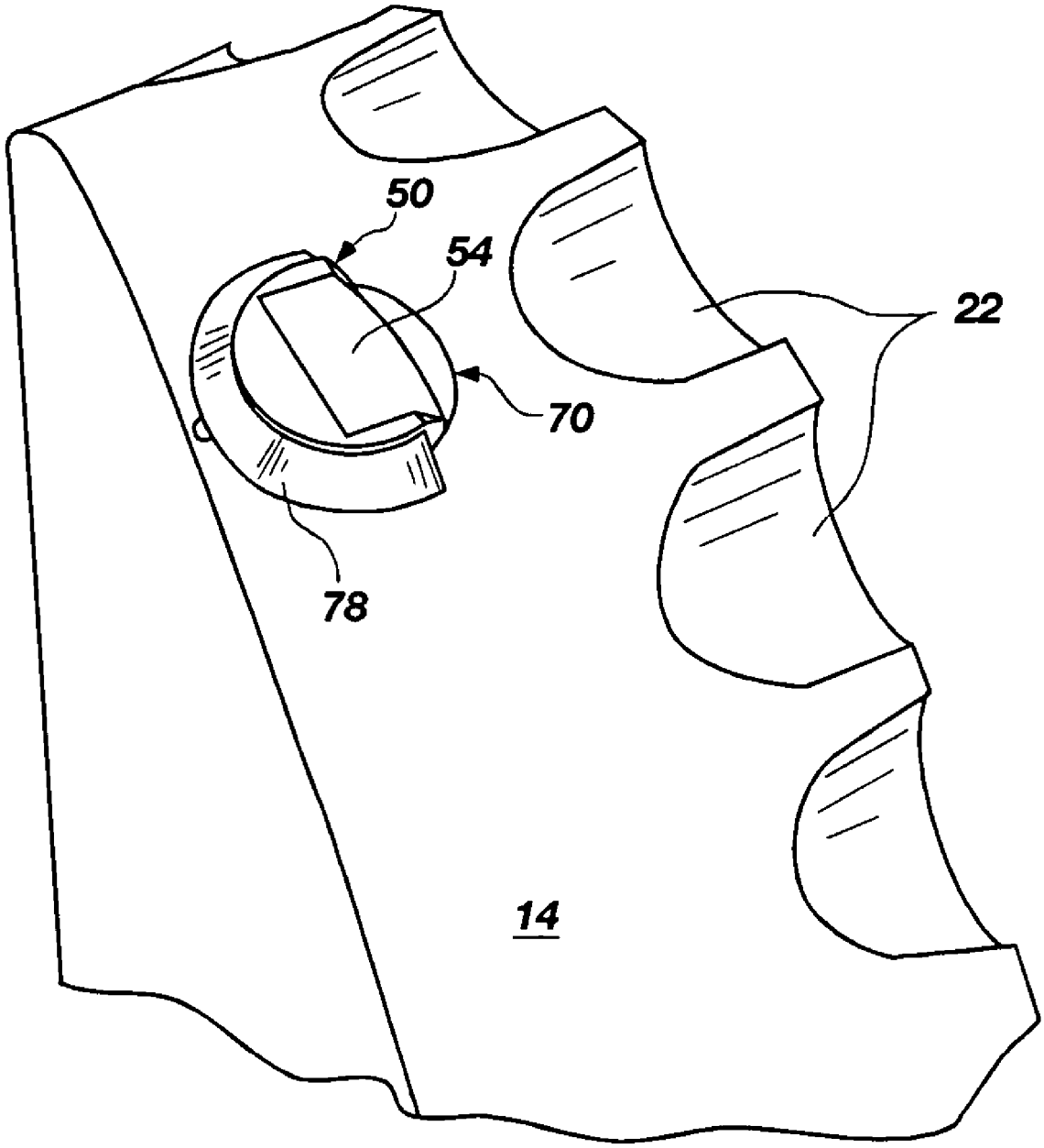

Referring to FIG. 5E, in addition to, or as an alternative to, the previously described means for securing the cutter insert 50 within the cutter insert recess 70, a weld bead 78 may be provided along at least a portion of an interface between the cutter insert 50 and the region of the blade 14 adjacent the cutter insert recess 70. Again, such a method of securing the cutter insert 50 within the cutter insert recess 70 facilitates removal and repair of the cutter insert 50. Moreover, a hard-facing material (not shown in FIG. 5E) may be selectively applied over and around selected areas of the cutter insert 50, the weld bead 78, and the surrounding regions of the blade 14 as necessary or desired. Such hard-facing materials are well known in the art and often include hard particles (such as, for example, particles of tungsten carbide material) dispersed throughout a metal alloy matrix material, and may be used to prevent wear of the underlying structures. Notably, no additional heat cycles of the bit body are required when fabricating a drill bit incorporating the present invention.

Figure 5F:
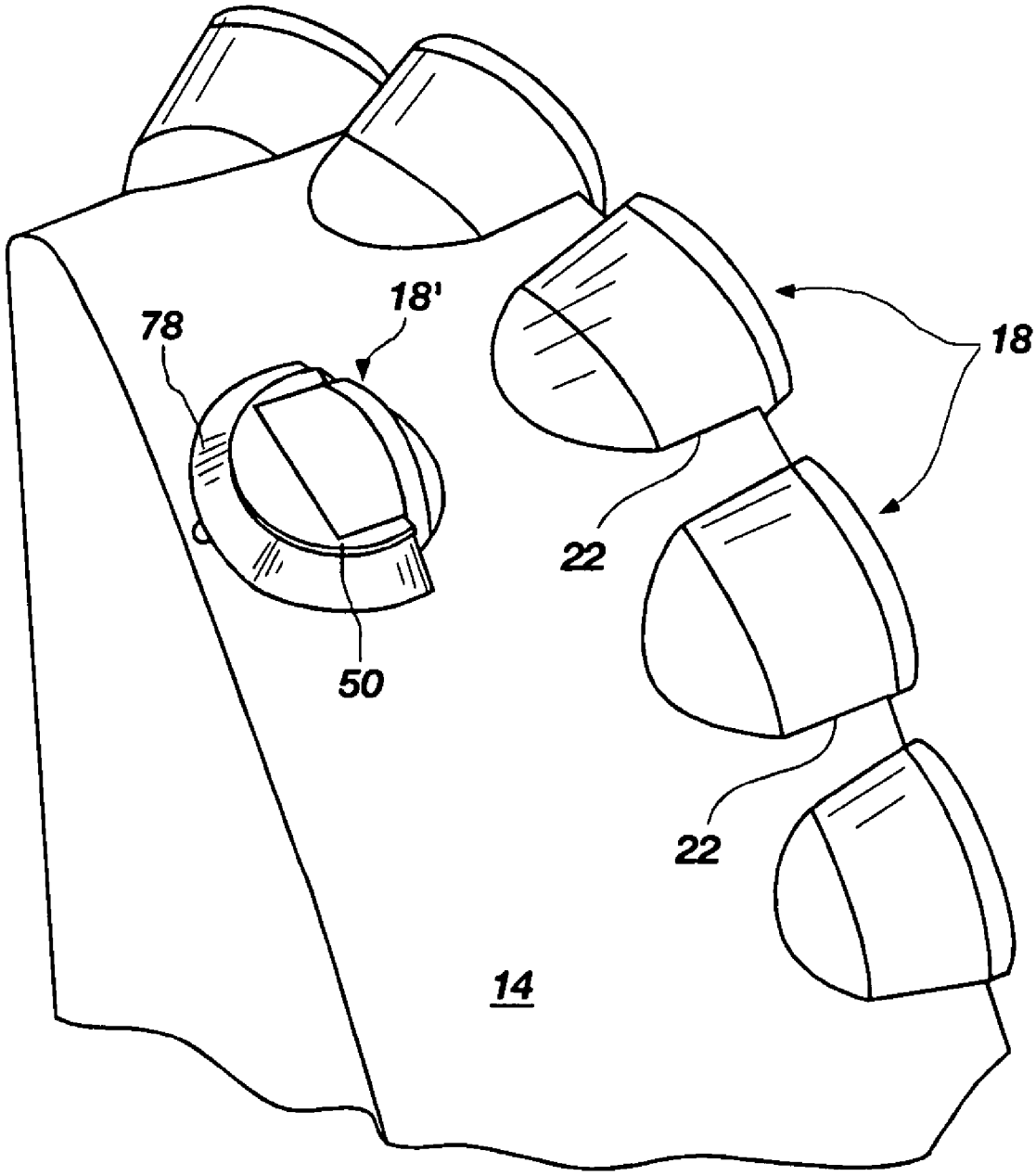

After the cutter insert 50 has been inserted into and secured within the cutter insert recess 70, a backup cutter 18' may be inserted into and secured within the cutter recess 54 (FIG. 3C) of the cutter insert 50, as shown in FIG. 5F. By way of example and not limitation, the backup cutter 18' may be secured within the cutter recess 54 using a brazing material or an adhesive material in a similar manner to that described previously herein for securing the cutter insert 50 within the cutter insert recess 70. In additional methods, a backup cutter 18' may be inserted into and secured within a cutter recess 54 of a cutter insert 50 prior to inserting and/or securing the cutter insert 50 within a cutter insert recess 70, although thermal constraints may dictate that this approach not be taken due, for example, to the potential for damage to the diamond table of a backup cutter 18' if welding is to be used to secure a cutter insert 50 to a blade 14.

While the backup cutter 18' has been described and illustrated herein as comprising a PDC cutter, in additional embodiments the backup cutter 18' may comprise any type or configuration of superabrasive or other cutter known in the art, such as, for example, a stud that comprises a hard material such as tungsten carbide, but does not include a diamond table thereon. Furthermore, while only a single cutter insert 50 and a single backup cutter 18' have been described herein and illustrated in the figures thus far, a steel-bodied drill bit 10 may be provided with a plurality of cutter inserts 50 and a plurality of backup cutters 18'.

Figure 6:
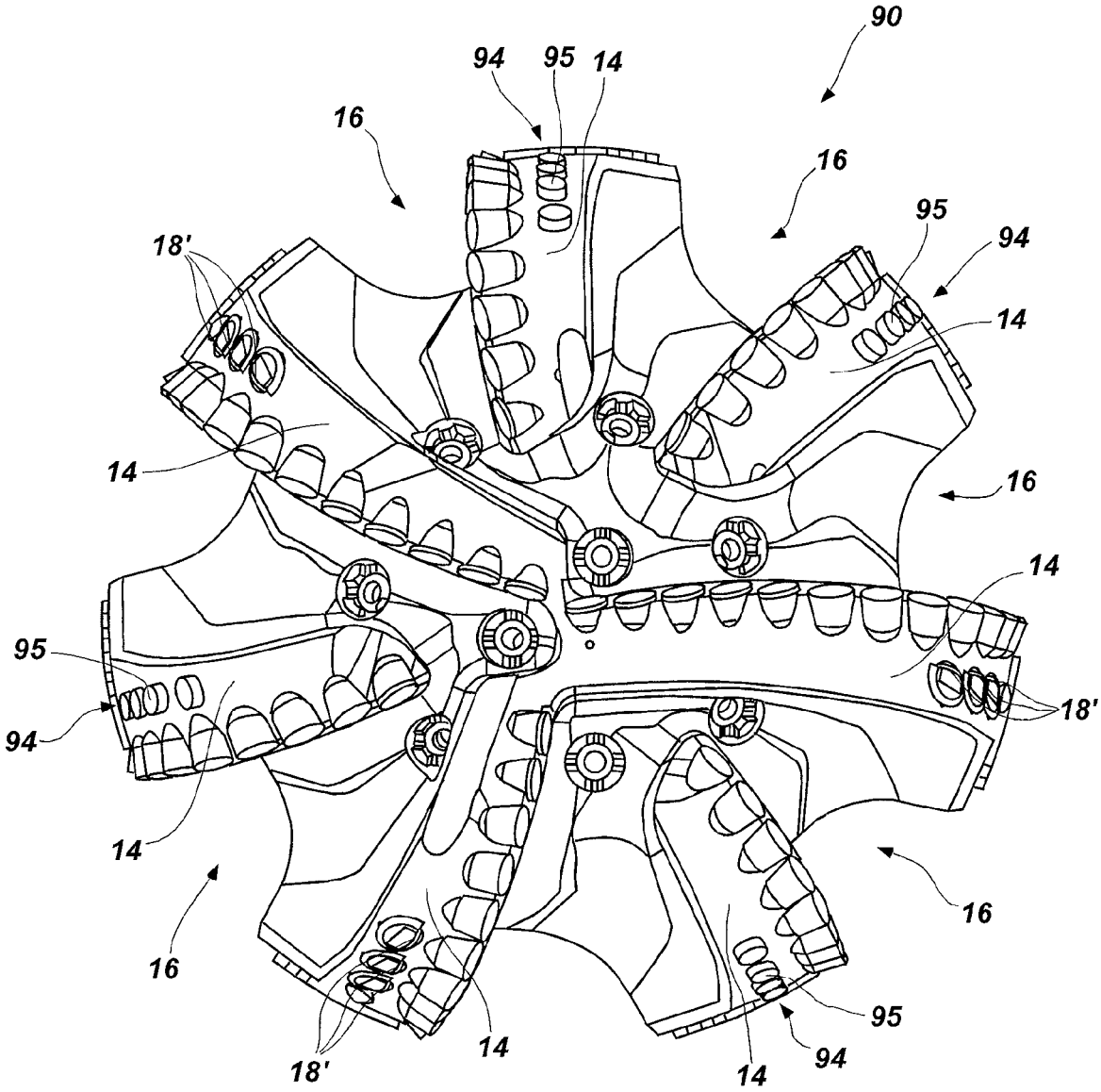
FIG. 6 is an end view of a fixed-cutter rotary drill bit illustrating various locations on blades of a drill bit at which backup cutting cutters may be mounted using cutter inserts like those shown in FIGS. 3A-3D.

An end view of a fixed-cutter rotary drill bit 90 of the present invention is shown in FIG. 6. As seen therein, a plurality of backup cutters 18' may be secured to at least one blade 14 of the drill bit 90 using cutter inserts 50 (not shown in FIG. 6), as previously described herein. Each backup cutter 18' may include a PDC backup cutter 18'. In some embodiments, each backup cutter 18' may have a diameter that is smaller than a diameter of a primary cutter 18. For example, each backup cutter 18' may have a diameter that is smaller than a diameter of a primary cutter 18 that is disposed on the same blade 14 and rotationally forward therefrom. In additional embodiments, each backup cutter 18' may have a diameter that is equal to or larger than a diameter of a primary cutter 18 that is disposed on the same blade 14 and rotationally forward therefrom. Furthermore, at least one backup cutter 18' may be provided on each primary blade 14 of the drill bit 90 (as used herein, the term "primary blade" means a blade 14 that extends substantially to the center of a drill bit), as shown in FIG. 6. In additional embodiments, one or more backup cutters 18' may be provided on each blade 14 of the drill bit 90.

As seen in FIG. 6, at least one blade 14 of the drill bit 90 may include one or more bearing structures 94 in lieu of backup cutters 18'. Each bearing structure 94 may include a stud or pad comprising a hard material such as, for example, tungsten carbide. Each bearing structure 94 may have at least one bearing surface 95 configured to engage a surface of a subterranean formation during drilling. Furthermore, each bearing structure 94 may include a diamond table covering at least a portion of the bearing surface 95 thereof, diamond impregnated material, or any other structure or material comprising one or more diamonds configured to impart wear-resistance to the bearing structure 94.

Figure 7:
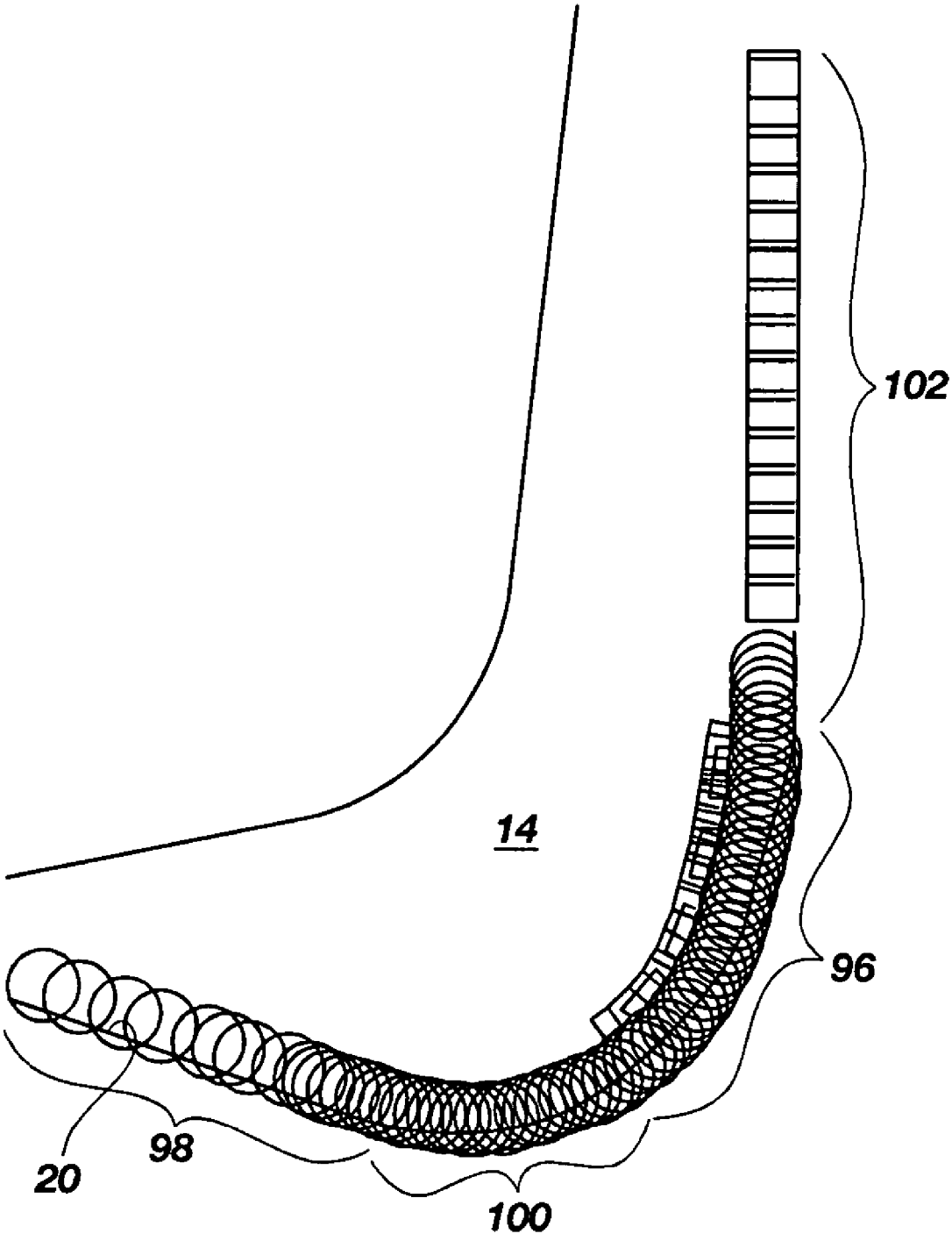
FIG. 7 illustrates the cutter profile of the fixed-cutter rotary drill bit shown in FIG. 6.

FIG. 7 illustrates what is known in the art as the "cutter profile" of the drill bit 90 shown in FIG. 6, and shows a cross-section of one blade 14. Each of the overlapping circles represents the position that would be occupied on the blade 14 by the primary cutters 18 and the backup cutters 18' if each of the primary cutters 18 and backup cutters 18' were rotated circumferentially about the longitudinal axis of the drill bit 90 to a position on the blade 14 shown in FIG. 7. In some embodiments, the backup cutters 18' may be provided substantially along the shoulder region, which is indicated in FIG. 7 generally at 96, of each blade 14 on which the respective backup cutters 18' are mounted. In additional embodiments, at least one backup cutter 18' may be provided within a cone region (indicated generally at 98), within a nose region (indicated generally at 100), or within a gage region (indicated generally at 102) of each blade 14 on which the respective backup cutters 18' are mounted. In some embodiments, a backup cutter 18' may be configured to be relatively under-exposed relative to a primary cutting element 18. In other words, a backup cutter 18' may extend outward from the face 20 of a blade 14 by a distance that is less than a distance by which a primary cutter 18 positioned rotationally forward therefrom on the same blade extends outward from the face 20 of the blade 14. In additional embodiments, a backup cutter 18' may be configured to be relatively overexposed relative to a primary cutting element 18, or to have a substantially equal exposure relative to a primary cutting element 18. In other words, a backup cutter 18' may extend outward from the face 20 of a blade 14 by a distance that is equal to, or greater than, a distance by which a primary cutter 18 positioned rotationally forward therefrom on the same blade extends outward from the face 20 of the blade 14.

A rotary drill bit having a steel body and six blades was fabricated according to the present invention. Between two and three backup cutters were secured to the face of the drill bit on each of the blades in a shoulder region thereof using cutter inserts in a manner substantially similar to that previously described in relation to the cutter insert 50 and backup cutter 18' with reference to FIGS. 5A-5F. The drill bit was then used in four test runs, two of which were conducted in each of two different subterranean formations. The test runs included both drilling a well bore hole, and reaming out a previously drilled well bore hole. The operating parameters for the four test runs were carried out at maximum weights-on-bit (WOB) ranging from about 15,000 to about 30,000 pounds, maximum torques of between about 3,600 and about 7,500 foot-pounds, and maximum rates-of-penetration (ROP) of between about 100 and about 250 feet per hour.

After conducting the test runs, the backup cutters were inspected, both visually and with the aid of a magnetic particle inspection (MPI) process, to determine whether the backup cutters and cutter inserts experienced unacceptable levels of wear. The backup cutters and cutter inserts did not appear to exhibit unacceptable levels of wear. In view of the above, the present invention may facilitate the use of backup cutters on rotary drill bits that have a steel bit body, which may facilitate the manufacture of steel-bodied rotary drill bits that exhibit improved durability and/or stability.

As discussed above, the present invention has utility in relation to rotary drill bits having bit bodies comprising steel. Recently, new methods of forming rotary drill bits having bit bodies comprising particle-matrix composite materials have been developed in an effort to improve the performance and durability of earth-boring rotary drill bits. Such methods are disclosed in pending U.S. patent application Ser. No. 11/271,153, filed Nov. 10, 2005 and pending U.S. patent application Ser. No. 11/272,439, also filed Nov. 10,2005, the disclosure of each of which application is incorporated herein in its entirety by this reference.

In contrast to conventional infiltration methods (in which hard particles (e.g., tungsten carbide) are infiltrated by a molten liquid metal matrix material (e.g., a copper based alloy) within a refractory mold, these new methods generally involve pressing a powder mixture to form a green powder compact, and sintering the green powder compact to form a bit body. The green powder compact may be machined as necessary or desired prior to sintering using conventional machining techniques like those used to form steel bit bodies. Furthermore, additional machining processes may be performed after sintering the green powder compact to a partially sintered brown state, and/or after sintering the green powder compact to a desired final density. For example, it may be desired to machine pockets 22' for backup cutters 18' (FIG. 2) on one or more blades 14 of a bit formed by such a process while the bit body is in the green, brown, or fully sintered state. However, as with steel-bodied drill bits, interference problems may prevent the formation of the desired pockets 22'. Therefore, embodiments of the present invention also may be used to secure backup cutters 18' to the face of a drill bit having a bit body comprising a particle-matrix composite material.

By way of example and not limitation, a cutter insert recess 70 like that shown in FIGS. 5A and 5B may be provided in the face 20 of a blade 14 comprising a particle-matrix composite material in the green, brown, or fully sintered state. Optionally, an alignment pin recess 72 like that shown in FIG. 5C also may be provided in the blade 14. A cutter insert 50 like that shown in FIGS. 3A-3D then may be secured within the cutter insert recess 22, as shown in FIG. 5D. In some embodiments, the cutter insert 50 may be secured to the blade 14 by co-sintering the blade 14 (or bit body) and the cutter insert 50. In such embodiments, the cutter insert 50 may comprise a green or brown structure when the cutter insert 50 is positioned within the cutter insert recess 22, and the cutter insert 50 may be sintered to a desired final density as the cutter insert 50 is co-sintered with the blade 14 and secured thereto. In other embodiments, the cutter insert 50 may have a desired final density prior to positioning the cutter insert 50 within the cutter insert recess 70. In yet other embodiments, the cutter insert 50 may not be inserted into the cutter insert recess 70 until after the blade 14 and the bit body have been sintered to a desired final density. A backup cutter 18' then may be inserted into and secured within the cutter recess 54 of the cutter insert 50, as previously described in relation to FIG. 5F.

While the present invention has been described herein with respect to certain preferred embodiments, those of ordinary skill in the art will recognize and appreciate that it is not so limited. Rather, many additions, deletions and modifications to the preferred embodiments may be made without departing from the scope of the invention as hereinafter claimed. In addition, features from one embodiment may be combined with features of another embodiment while still being encompassed within the scope of the invention as contemplated by the inventors. Further, the invention has utility with different and various bit profiles as well as cutter types and configurations.

What is claimed is:

1. A cutter insert for a fixed-cutter rotary drill bit, the cutter insert comprising a generally cylindrical cutter insert body having a generally cylindrical lateral side surface extending to and intersecting at least one substantially planar end surface, the cutter insert body including a cutter recess therein at least partially defined by a planar surface of the cutter insert body and an arcuate surface of the cutter insert body, the arcuate surface intersecting the planar surface and extending therefrom, the planar surface of the cutter insert body oriented at an acute angle of less than ninety degrees (90°) relative to a longitudinal axis of the cutter insert body, the cutter recess extending into the at least one substantially planar end surface and configured to receive a portion of a cutting element therein.

2. The cutter insert of claim 1, wherein the cutter insert body comprises steel or tungsten carbide.

3. The cutter insert of claim 1, wherein the generally cylindrical cutter insert body is substantially cylindrical and comprises a substantially cylindrical lateral side surface extending between two substantially planar end surfaces.

4. The cutter insert of claim 3, wherein the planar surface of the cutter recess is oriented at an acute angle of less than ninety degrees (90°) relative to at least one of the two substantially planar end surfaces.

5. The cutter insert of claim 1, wherein the cutter recess is oriented to provide a selected back rake angle to a cutting element to be received therein.

6. The cutter insert of claim 1, wherein the arcuate surface of the cutter insert body comprises at least a partial cylindrical surface.

7. The cutter insert of claim 1, wherein the cutter insert includes at least one alignment feature configured to facilitate rotational alignment of the cutter insert on a face of a rotary drill bit.

8. The cutter insert of claim 7, wherein the at least one alignment feature comprises an alignment pin having an end thereof protruding from a surface of the cutter insert, the end configured to be at least partially received within an alignment pin recess in a face of a rotary drill bit.

9. The cutter insert of claim 1, wherein the cutter recess is further configured to position a portion of a cutting element within a recess in a bit body of a drill bit when the cutter insert body is positioned within the recess.

10. A cutter insert for a fixed-cutter rotary drill bit, the cutter insert comprising an elongated cutter insert body having a generally cylindrical lateral side surface extending to and intersecting at least one substantially planar end surface, the cutter insert body having at least one surface defining a cutter recess therein intersecting the at least one substantially planar end surface, the cutter recess extending into the cutter insert body along a recess axis oriented at an acute angle of less than ninety degrees (90°) relative to a longitudinal axis of the cutter insert body.

11. The cutter insert of claim 10, wherein the at least one surface defining the cutter recess comprises:

a planar surface of the cutter insert body; and an arcuate surface of the cutter insert body, the arcuate surface intersecting the planar surface and extending therefrom.

12. The cutter insert of claim 11, wherein the planar surface of the cutter insert body is oriented at an acute angle of less than ninety degrees (90°) relative to the longitudinal axis of the cutter insert body.

13. The cutter insert of claim 10, wherein the cutter insert body comprises steel or tungsten carbide.

14. The cutter insert of claim 10, wherein the elongated cutter insert body is generally cylindrical and comprises a generally cylindrical lateral side surface extending between two end surfaces.

15. The cutter insert of claim 14, wherein the elongated cutter insert body is substantially cylindrical and comprises a substantially cylindrical lateral side surface extending between two substantially planar end surfaces.

16. The cutter insert of claim 10, wherein the at least one surface of the cutter insert body defining a cutter recess comprises at least a partial cylindrical surface.

17. The cutter insert of claim 10, wherein the cutter insert includes at least one alignment feature configured to facilitate rotational alignment of the cutter insert on a face of a rotary drill bit.

18. The cutter insert of claim 17, wherein the at least one alignment feature comprises an alignment pin having an end thereof protruding from a surface of the cutter insert, the end configured to be at least partially received within an alignment pin recess in a face of a rotary drill bit.

19. A fixed-cutter rotary drill bit for drilling a subterranean formation, the drill bit comprising:

a bit body comprising a plurality of blades extending over a face thereof, each blade comprising a plurality of primary cutter pockets proximate a leading edge of each blade configured to receive a primary cutting element therein;

at least one cutter insert affixed to a blade of the plurality of blades within an insert recess extending into a face of the blade rotationally behind a primary cutter pocket of the plurality, the at least one cutter insert comprising a cutter insert body having at least one surface defining a cutter recess therein, the cutter recess at least partially recessed relative to the face of the blade and configured to receive at least a portion of a backup cutting element therein.

20. The rotary drill bit of claim 19, wherein the cutter insert comprises a generally cylindrical cutter insert body having a cutter recess therein at least partially defined by a planar surface of the cutter insert body and an arcuate surface of the cutter insert body, the arcuate surface intersecting the planar surface and extending therefrom.

21. The rotary drill bit of claim 20, wherein the arcuate surface of the cutter insert body comprises at least a partial cylindrical surface.

22. The rotary drill bit of claim 21, wherein the planar surface and the arcuate surface are configured, in combination, to provide a selected back rake angle to a backup cutting element to be received in the cutter recess.

23. The rotary drill bit of claim 20, wherein the planar surface of the cutter insert body is oriented at an acute angle of less than ninety degrees (90°) relative to a longitudinal axis of the cutter insert body.

24. The rotary drill bit of claim 23, wherein the cutter insert comprises an elongated cutter insert body, the cutter recess extending into the elongated cutter insert body along a recess axis oriented at an acute angle of less than ninety degrees (90°) relative to a longitudinal axis of the eleongated cutter insert body.

25. The rotaly drill bit of claim 19, wherein the at least one cutter insert is affixed to the blade of the plurality of blades such that a longitudinal axis of the cutter insert body is oriented substantially perpendicular to the face of the blade.

26. The rotary drill bit of claim 25, wherein the at least one cutter insert and the blade are configured, in combination, to provide a selected side rake angle to a backup cutting element to be received in the cutter recess.

27. The rotary drill bit of claim 19, wherein the at least one cutter insert is affixed to the blade by at least one of welding, brazing, press-fit, and shrink-fit.

28. The rotary drill bit of claim 19, further comprising at least one backup cutting element disposed at least partially within the cutter recess of the at least one cutter insert.

29. The rotary drill bit of claim 28, wherein the at least one backup cutting element is directly bonded predominantly to the at least one cutter insert within the cutter recess.

30. The rotary drill bit of claim 28, wherein the at least one backup cutting element comprises a polycrystalline diamond compact cutting element.

31. The rotary drill bit of claim 28, wherein the at least one backup cutting element is at least partially secured within the cutter recess of the at least one cutter insert by at least one of brazing and adhesive bonding.

32. The rotary drill bit of claim 19, wherein the at least one cutter insert comprises steel or tungsten carbide.

33. A method of manufacturing a fixed-cutter rotary drill bit, the method comprising:

providing a bit body including a plurality of blades, each blade of the plurality having a face;

forming at least one cutter insert recess in the face of at least one blade of the plurality at a location rotationally behind a cutter pocket of the at least one blade configured to receive a primary cutter therein;

providing at least one cutter insert comprising a cutter insert body having at least one surface defining a cutter recess therein, the cutter recess configured to receive at least a portion of a backup cutting element therein;

securing the at least one cutter insert at least partially within the at least one cutter insert recess such that the cutter recess is at least partially recessed relative to the face of the at least one blade; and securing at least one backup cutter at least partially within the cutter recess of the at least one cutter insert.

34. The method of claim 33, wherein providing at least one cutter insert comprising a cutter insert body comprises:

forming the cutter insert body to be generally cylindrical; and machining the cutter insert body to form a planar surface of the cutter insert body and an arcuate surface of the cutter insert body intersecting the planar surface and extending therefrom, the planar surface and the arcuate surface each at least partially defining the cutter recess.

35. The method of claim 34, wherein machining the cutter insert body comprises forming the arcuate surface of the cutter insert body to comprise a partial cylindrical surface.

36. The method of claim 34, further comprising configuring the planar surface of the cutter insert body and the arcuate surface of the cutter insert body to provide a selected back rake angle to the at least one backup cutter.

37. The method of claim 34, further comprising orienting the planar surface of the cutter insert body at an acute angle of less than ninety degrees (90°) relative to a longitudinal axis of the cutter insert body.

38. The method of claim 33, wherein providing at least one cutler insert comprising a cutter insert body comprises:

forming the cutter insert body to be elongated; and machining the cutter recess in the elongated cutter insert body and centering the cutter recess about a recess axis oriented at an acute angle of less than ninety degrees (90°) relative to a longitudinal axis of the elongated cutter insert body.

39. The method of claim 33, wherein securing at least one backup cutter at least partially within the cutter recess of the at least one cutter insert comprises securing at least one backup cutter at least partially within the cutter recess of the at least one cutter insert prior to securing the at least one cutter insert at least partially within the at least one cutter insert recess.

40. The method of claim 33, wherein securing at least one backup cutter at least partially within the cutter recess of the at least one cutter insert comprises securing at least one backup cutter at least partially within the cutter recess of the at least one cutter insert subsequent to securing the at least one cutter insert at least partially within the at least one cutter insert recess.

41. The method of claim 33, wherein forming at least one cutter insert recess in the face of at least one blade comprises machining at least one cutter insert recess in the face of the at least one blade.

42. The method of claim 41, wherein machining at least one cutter insert recess in the face of at least one blade comprises drilling at least one substantially cylindrical cutter insert recess in the face of the at least one blade.

43. The method of claim 42, wherein drilling at least one substantially cylindrical cutter insert recess in the face of at least one blade comprises drilling into the face of at least one blade substantially along a drilling axis oriented substantially perpendicular to the face of the at least one blade at the intersection between the face of the at least one blade and me drilling axis.

44. The method of claim 33, wherein securing the at least one cutter insert at least partially within the at least one cutter insert recess comprises at least one of welding, brazing, press-fitting, and shrink-fitting.

45. The method of claim 33, wherein securing at least one backup cutter at least partially within the cutter recess of the at least one cutter insert comprises at least one of brazing and adhesive bonding.

46. The method of claim 33, further comprising providing a hardfacing material over at least a portion of an exposed surface of the at least one cutter insert.

47. The method of claim 33, further comprising providing a bardfacing material over at least one of at least a portion of an interface between the at least one cutter insert and the at least one blade and at least a portion of an interface between the at least one backup cutter and the at least one cutter insert.

48. The method of claim 33, wherein providing a bit body comprises providing a bit body predominantly comprised of steel.

49. The method of claim 33, wherein providing a bit body comprises providing a bit body predominantly comprised of a particle-matrix composite material.

* * * * *

UNITED STATES PATENT AND TRADEMARK OFFICE

CERTIFICATE OF CORRECTION

PATENT NO. : 7,594,554 B2
APPLICATION NO. : 11/709925
DATED : September 29, 2009
INVENTOR(S) : Thorsten Schwefe et al.

It is certified that error appears in the above-identified patent and that said Letters Patent is hereby corrected as shown below:

In the specification:

| | | |
|---|---|---|
| COLUMN 2, | LINE 38, | change “and/r” to --and/or-- |
| COLUMN 6, | LINE 43, | change “maybe” to --may be-- |
| COLUMN 9, | LINE 28, | change “Nov. 10,2005,” to --Nov. 10, 2005,-- |
| COLUMN 9, | LINE 60, | change “recess **22**,” to --recess **70**,-- |
| COLUMN 9, | LINE 65, | change “recess **22**,” to --recess **70**,-- |

In the claims:

| | | |
|---|---|---|
| CLAIM 24, COLUMN 12, | LINE 9, | change “eleongated cutter” to --elongated cutter-- |
| CLAIM 25, COLUMN 12, | LINE 11, | change “The rotaly” to --The rotary-- |
| CLAIM 38, COLUMN 13, | LINE 10, | change “cutler insert” to --cutter insert-- |
| CLAIM 43, COLUMN 14, | LINE 10, | change “and me” to --and the-- |
| CLAIM 47, COLUMN 14, | LINE 24, | change “a bardfacing” to --a hardfacing-- |

Signed and Sealed this
Twenty-fourth Day of January, 2012

David J. Kappos

David J. Kappos
*Director of the United States Patent and Trademark Office*